US006836938B2

(12) United States Patent
Fleissner

(10) Patent No.: US 6,836,938 B2
(45) Date of Patent: Jan. 4, 2005

(54) METHOD AND DEVICE FOR PRODUCTION OF COMPOSITE NON-WOVEN FIBER FABRICS BY MEANS OF HYDRODYNAMIC NEEDLING

(75) Inventor: Gerold Fleissner, Zug (CH)

(73) Assignee: Fleissner GmbH & Co., Maschinenfabrik, Egelebach (DE)

( * ) Notice: Subject to any disclaimer, the term of this patent is extended or adjusted under 35 U.S.C. 154(b) by 0 days.

(21) Appl. No.: 10/149,152

(22) PCT Filed: Jan. 13, 2001

(86) PCT No.: PCT/EP01/00383

§ 371 (c)(1),
(2), (4) Date: Oct. 9, 2002

(87) PCT Pub. No.: WO01/53588

PCT Pub. Date: Jul. 26, 2001

(65) Prior Publication Data

US 2003/0106195 A1 Jun. 12, 2003

(30) Foreign Application Priority Data

Jan. 17, 2000 (DE) ..... 100 01 723
Feb. 3, 2000 (DE) ..... 100 04 448

(51) Int. Cl.[7] ..... D04H 5/02
(52) U.S. Cl. ..... 28/104; 28/167
(58) Field of Search ..... 28/104, 105, 106, 28/167, 103, 166; 442/408, 382, 384, 385, 387, 401, 413; 156/148, 62.2, 182

(56) References Cited

U.S. PATENT DOCUMENTS 4,808,467 A * 2/1989 Suskind et al. ..... 442/384
4,931,355 A * 6/1990 Radwanski et al. ..... 442/344
4,950,531 A * 8/1990 Radwanski et al. ..... 442/351
5,137,600 A * 8/1992 Barnes et al. ..... 162/115
5,144,729 A * 9/1992 Austin et al. ..... 28/105
5,151,320 A * 9/1992 Homonoff et al. ..... 442/384
5,328,759 A * 7/1994 McCormack et al. ..... 442/402
5,380,580 A * 1/1995 Rogers et al. ..... 428/219
6,022,818 A * 2/2000 Welchel et al. ..... 442/384
6,063,717 A * 5/2000 Ishiyama et al. ..... 442/387
6,177,370 B1 * 1/2001 Skoog et al. ..... 442/387
6,592,713 B2 * 7/2003 Ahoniemi ..... 162/103
2003/0024092 A1 * 2/2003 Orlandi ..... 28/104

FOREIGN PATENT DOCUMENTS

EP 560556 * 9/1993
WO WO 99/22059 * 5/1999

* cited by examiner

*Primary Examiner*—Amy B. Vanatta
(74) *Attorney, Agent, or Firm*—Antonelli, Terry, Stout & Kraus, LLP

(57) ABSTRACT

Method for producing a composite non-woven fabric for the production of a hygiene product includes the steps of forming a spun-bonded non-woven fabric; compressing the spun-bonded non-woven fabric in the dry state in a continuous process after forming the spun-bonded non-woven fabric for pre-strengthening; coating the pre-strengthened spun-bonded non-woven fabric with a layer of pulp fibers; conducting a hydrodynamic water needling process to interconnect and strengthen the layer of pulp fibers and the pre-strengthened spun-bonded non-woven fabric to form a composite non-woven fabric; and then drying the composite non-woven fabric. The step of compressing the spun-bonded non-woven fabric provides only a light bonding of fibers of the spun-bonded non-woven fabric such that the pulp fibers enter into an internal bonding with fibers of the spun-bonded non-woven fabric in the hydrodynamic water needling process.

8 Claims, 2 Drawing Sheets

METHOD AND DEVICE FOR PRODUCTION OF COMPOSITE NON-WOVEN FIBER FABRICS BY MEANS OF HYDRODYNAMIC NEEDLING

BACKGROUND OF THE INVENTION

EP-A-0 333 209 makes known binding endless elastomer fibres and wood pulp fibres together hydrodynamically and in so doing strengthening the composite non-woven fabric. With this method of strengthening there is the danger that a large quantity of pulp fibres is washed out of the system, in other words fibres are lost. In addition, it has also been established in practice that the outer layer of such a composite non-woven fabric tends to pellet, as is described in WO 90/04066. For improvement, EP-A-0 540 041 proposes treating the endless fibre non-woven fabric hydrodynamically before the application of the pulp fibres. This is to give the non-woven fabric not only greater strength, but also to improve the absorption power of the pulp fibres and the fluid distribution properties. According to this document, the pulp fibres are then simply applied to the needled non-woven fabric and are then dried with the non-woven fabric for bonding or are pressed mechanically into the non-woven fabric.

It has been possible to establish that none of these types of producing non-woven fabric products fulfils the conditions in practice. More especially, complaints have been made about the composite non-woven fabrics tending to pellet, on the outer side of the endless fibre non-woven fabric.

SUMMARY OF THE INVENTION

It is the object of the invention to find a method and the associated device with which this easy surface wearability is improved, but where, nevertheless, a good bonding of the pulp fibres in the carrier non-woven fabric is achievable. Care must also be taken to ensure that the applied pulp layer is not lost or is only very slightly lost where there is efficient bonding with the carrier non-woven fabric.

Proceeding from EP-A-0 540 041, the invention achieves the object of the task set in that, before being coated with the super absorbent material, the spun bonded non-woven fabric is pre-strengthened, is needled with air or is calendered for pre-strengthening, the wood pulp layer is then applied and the two together are strengthened with a hydrodynamic water needling process and are then dried. The strengthening of the calendering of the endless fibre non-woven fabric before further processing not only improves the abrasion resistance of the end product, but also reduces a loss of pulp in the water needling in and through the non-woven fabric. However, it must be noted that this calendering must not be too strong. If the strengthening is too great and the bonding points too various, the bonding of the pulp layer to the calendered non-woven fabric is made difficult through the water needling process. For this reason, to improve the pelleting tendency, the non-woven fabric can be calendered once again at the end of the bonding process after drying and this makes a fixed bonding of all surface fibres achievable. Where a non-woven fabric product has only one spun-bonded layer, only the roller adjacent to the spun-bonded layer needs to be heated.

However, it can also be advantageous to carry out a hot calendering process on the surface of the pulp layer, where applicable. This produces so-called hydrogen bonds in the cellulose fibres such that a sealed paper-like surface is achieved on the side of the wood pulp. Such a product can then also be used for medical purposes, for which in the event of producing operation garments or covers, the non-woven fabric should also be equipped hydrophobically.

It must be established that in this manufacturing method the pulp layer is bonded to the non-woven fabric hydrodynamically, otherwise the product cannot exist in practice on account of a layer formation. It is even better if another pre-strengthened endless fibre or card non-woven fabric is applied to the pulp layer and the three layers are needled hydrodynamically together. A final calendering is also advantageous. It is also advantageous to use a calendered card non-woven fabric as carrier non-woven fabric in place of an endless fibre non-woven fabric, to which a spun-bonded non-woven fabric is applied as covering layer.

BRIEF DESCRIPTION OF THE DRAWINGS

A corresponding device for the performance of the method is represented schematically in the drawing: In which.

DETAILED DESCRIPTION OF THE PREFERRED EMBODIMENTS

Figure 4:
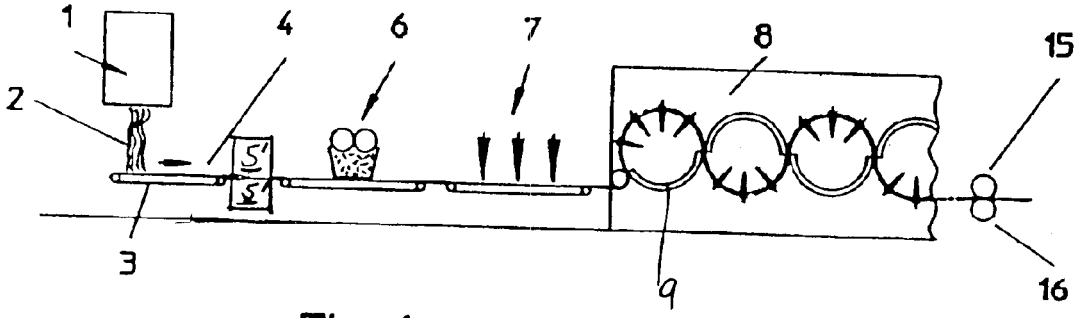
FIG. 4 is a side view of a continuous system similar to that of FIG. 1 but using a compressed air strengthening apparatus instead of a calendering apparatus.

The endless fibres 2, continuously emerging from the device 1, which is substantially known and does not need to be represented in detail, impact onto the conveyor belt 3, which is running below in the direction of the arrow 4. A calender apparatus 5 is assigned to the conveyor belt 3, which calender apparatus 5, depending on what is required, supplies a strengthened non-woven fabric, which where applicable is also finely pressed, with force and heat. The calender apparatus can also be replaced by a compressed air strengthening apparatus 5', as shown in FIG. 4. The strengthening effect should only be slight so that the pulp still enters into an internal bonding with the endless fibre non-woven fabric by means of the needling process. After this method step, the pulp fibres are applied, as is known, using, for example, a device 6 according to EP-A-0 032 772. The hydrodynamic needling process 7 is then applied to both non-woven fabric layers together, it also being possible to perform the hydrodynamic needling process on a permeable drum as in FIG. 2 in place of the conveyor belt in FIG. 1. The drying process on a sieve drum device 8, 9 with through-ventilation then follows. In the case of device 8, the ventilator is assigned to the sieve drums 9 directly at the front. Finally, yet another calendering 15, 16 should take place, but this time one with a greater force. The intenseness of the strengthening must be such that the end product has greater, satisfactory abrasion resistance. In the example in FIG. 1, only the roller 16, which is in contact with the spun-bonded non-woven fabric, needs to be heated.

Figure 1:
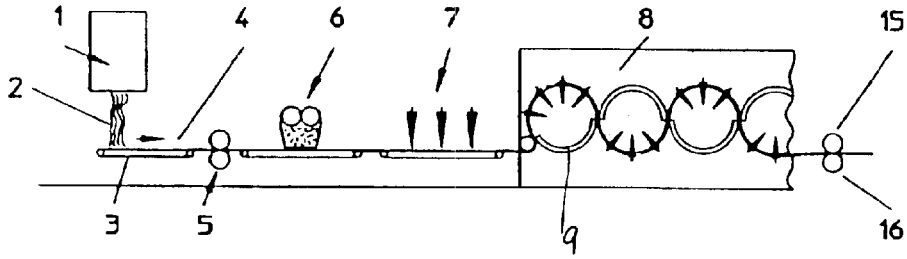
FIG. 1 is a side view of a continuous system for the production of a composite non-woven fabric only with one carrier substrate.
Figure 2:
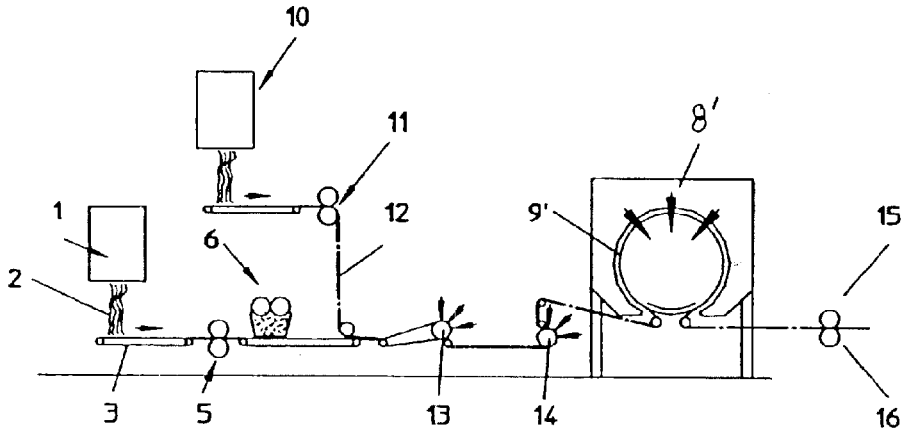
FIG. 2 is also a side view of the system in FIG. 1 supplemented by the supply of an additional covering layer made from an endless fibre non-woven fabric upstream of the water needling and FIG. 3 is a system as in FIG. 2 but with a carding system at the entry for the production of a card non-woven fabric as carrier layer.

The continuous system in FIG. 2 corresponds to that in FIG. 1, with only one other second, only lightly pre-strengthened endless fibre non-woven fabric being created with the device 10, which non-woven fabric can also naturally be submitted or pre-produced using a roller (not illustrated). This also applies to the carrier non-woven fabric in FIG. 1 with the device 1–4. The top covering non-woven fabric 12 is to be pre-strengthened at all times also with a calender 11. After the covering non-woven fabric 12 has been deposited on the pulp layer, which was applied to the basic non-woven fabric from the apparatus 1, 5 using the device 6, the aforementioned water needling process is carried out, which in this exemplified embodiment can also take place from both sides, also where applicable in multiple stages, as the pulp layer is covered on both sides by a non-woven fabric. For this purpose there are needling drums 13, 14, which are disposed one behind the other and are travelled round in a meander-shaped manner and to which each of the jets, indicated by the arrows, are assigned from above. The subsequent drying process is effected here with another type of through-ventilation drier 8', the ventilator being assigned externally to the sieve drum 9' of this drier 8'. Finally, the calender 15, 16 can also be run through here, but in that case both drums 15, 16 must be heated.

Up to now only the production of a spun-bonded non-woven fabric has been discussed for the subsequent calendering. Obviously, in place of a spun-bonded non-woven fabric, a card non-woven fabric can also be produced as carrier non-woven fabric, be calendered 5 and consequently pre-strengthened and the pulp layer 6 can be applied to this non-woven fabric.

Figure 3:
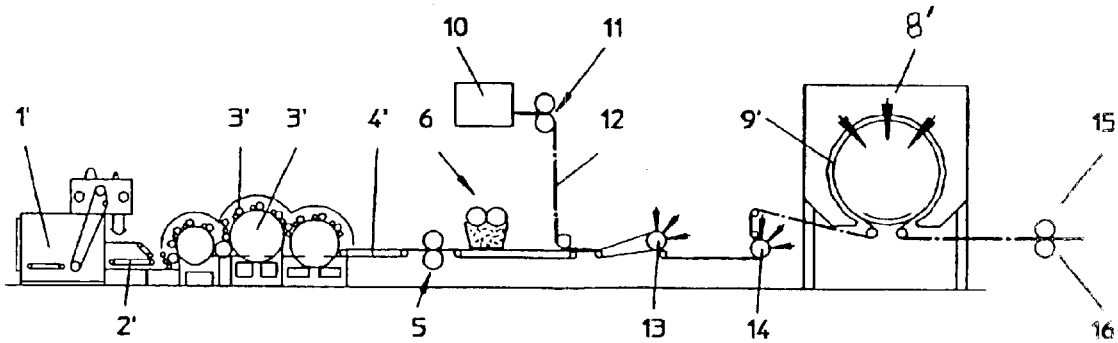

This is represented in FIG. 3. A card 1'–4' is used as the non-woven fabric placing apparatus. The card comprises a box tank 1' with a vibrating chute 2' disposed underneath it, which chute transfers the fibres, which are spread out uniformly over the width, to the card using the scrape and tear rollers 3'. The following conveyor belt 4' transfers the card non-woven fabric to the calendering apparatus 5 as described above. A spun-bonded non-woven fabric is used in this case as the covering layer 12 after the pulp layer, which spun-bonded non-woven fabric can be formed in the unit 10, which is schematically represented. There can also be a requirement to use a spun-bonded non-woven fabric as carrier non-woven fabric, to which a card non-woven fabric is applied after the pulp layer. In this case, the unit 10 would then represent an apparatus as is identified by the references 1'–4', whilst a spun-bonding device similar to the references 1, 2 is disposed in the place of the card.

What is claimed is:

1. Method for producing a composite non-woven fabric for the production of a hygiene product comprising;

forming a spun-bonded non-woven fabric;

compressing the spun-bonded non-woven fabric in the dry state in a continuous process after forming the spun-bonded non-woven fabric for pre-strengthening;

coating the pre-strengthened spun-bonded non-woven fabric with a layer of pulp fibers;

conducting a hydrodynamic water needling process to interconnect and strengthen the layer of pulp fibers and the pre-strengthened spun-bonded non-woven fabric to form a composite non-woven fabric; and then drying the composite non-woven fabric, wherein the step of compressing the spun-bonded non-woven fabric provides only a light bonding of fibers of the spun-bonded non-woven fabric such that the pulp fibers enter into an internal bonding with fibers of the spun-bonded non-woven fabric in the hydrodynamic water needling process.

2. Method according to claim 1, characterised in that the step of compressing the spun-bonded non-woven fabric is performed with compressed air.

3. Method according to claim 1 characterised in that the step of compressing the spun-bonded non-woven fabric is performed by calendaring.

4. Method according to claim 1, further comprising applying a covering layer to the layer of pulp fibers before the step of conducting a hydrodynamic water needling process.

5. Method according to claim 4, characterised in that the covering layer is a pre-strengthened and calendered spun-bonded non-woven fabric.

6. Method according to claim 4, cheracterised in that the covering layer is a pre-strengthened and calendered card non-woven fabric.

7. Method according to claim 1, further comprising calendering the dried composite non-woven fabric.

8. A composite non-woven fabric produced by the method of claim 1.

* * * * *